US009305483B2

(12) United States Patent
Lee et al.

(10) Patent No.: US 9,305,483 B2
(45) Date of Patent: Apr. 5, 2016

(54) DISPLAY DEVICE INCLUDING A TIMING CONTROLLER WITH A SELF-RECOVERY BLOCK AND METHOD FOR DRIVING THE SAME

(71) Applicant: LG DISPLAY CO., LTD., Seoul (KR)

(72) Inventors: Hwanjoo Lee, Daegu (KR); Hayoung Ji, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 73 days.

(21) Appl. No.: 14/066,554

(22) Filed: Oct. 29, 2013

(65) Prior Publication Data

US 2014/0118330 A1 May 1, 2014

(30) Foreign Application Priority Data

Oct. 30, 2012 (KR) ..... 10-2012-0121122

(51) Int. Cl.
*G09G 3/00* (2006.01)
*G09G 3/20* (2006.01)

(52) U.S. Cl.
CPC ..... *G09G 3/2096* (2013.01); *G09G 2330/022* (2013.01); *G09G 2330/026* (2013.01); *G09G 2330/06* (2013.01); *G09G 2370/08* (2013.01)

(58) Field of Classification Search
CPC G09G 2310/08; G09G 2330/12; G09G 5/008
See application file for complete search history.

(56) References Cited

U.S. PATENT DOCUMENTS

| | | | | |
|---|---|---|---|---|
| 2003/0071767 | A1* | 4/2003 | Park | 345/42 |
| 2004/0228265 | A1* | 11/2004 | Ota | 369/292 |
| 2007/0126686 | A1* | 6/2007 | Chang et al. | 345/98 |
| 2011/0164076 | A1* | 7/2011 | Lee | 345/691 |
| 2012/0086741 | A1* | 4/2012 | Yokonuma | 345/690 |
| 2012/0242644 | A1* | 9/2012 | Liu et al. | 345/212 |

* cited by examiner

*Primary Examiner* — Sanghyuk Park
(74) *Attorney, Agent, or Firm* — Birch, Stewart, Kolasch & Birch, LLP

(57) ABSTRACT

A display device and a method for driving the same are discussed. The display device includes an image processing unit, a timing controller which receives various signals through a mobile industry processor interface (MIPI) connected to the image processing unit, and a display module displaying an image under the control of the timing controller. The timing controller includes a logic block for controlling the display module, and a self-recovery block which outputs a self-command signal for escaping an abnormal state when the logic block is faced with the abnormal state due to an external environment factor.

8 Claims, 8 Drawing Sheets

--Prior Art--

DISPLAY DEVICE INCLUDING A TIMING CONTROLLER WITH A SELF-RECOVERY BLOCK AND METHOD FOR DRIVING THE SAME

This application claims the benefit of Korean Patent Application No. 10-2012-0121122 filed on Oct. 30, 2012, the entire contents of which is incorporated herein by reference for all purposes as if fully set forth herein.

BACKGROUND OF THE INVENTION

1. Field of the Invention

Embodiments of the invention relate to a display device and a method for driving the same.

2. Discussion of the Related Art

The market of display devices used as media between users and information is increasing with the development of information technology. The display devices such as a liquid crystal display and an organic light emitting display have been manufactured to have various sizes including small, middle, and large sizes. Some display devices are implemented as a display device using a mobile industry processor interface (MIPI).

In a related art MIPI type display device, a system board transmits various signals including a command signal, a data signal, a clock, etc. to a timing controller through a MIPI. The command signal is closely related with a drive of the display device and includes a sleep mode and a display mode. The sleep mode of the command signal includes a mode indicating the exit of a sleep state and a mode indicating the entrance of the sleep state. The display mode of the command signal includes a mode defining a transmission period of the data signal and a mode defining a non-transmission period of the data signal.

The related art MIPI type display device may be abnormally turned off or on due to an external environment factor, for example, a surge of a very high voltage such as electrostatic discharge (ESD) and electrical overstress (EOS). In this instance, the timing controller reloads a register. However, if the command signal of the sleep mode is not received again from the system board, the related art MIPI type display device may appear an abnormal display state or stop working.

Namely, because the system board does not monitor a state of a power source supplied to a display module, the related art MIPI type display device appears the abnormal display state or stops working. Only when the power source is normally turned on, an image processing unit temporarily transmits the command signal including the sleep mode and the display mode to the timing controller. Thus, even when the timing controller and the display module are faced with an abnormal state of the power source, the image processing unit does not retransmit the command signal to the timing controller. Further, bidirectional communication between the system board and the timing controller is not performed in a video mode.

Accordingly, when the related art MIPI type display device is in the abnormal state due to the external environment factor such as the electrostatic discharge and the electrical overstress, it is difficult for the related art MIPI type display device to implement a normal image by escaping from the abnormal state.

SUMMARY OF THE INVENTION

In one aspect, there is a display device including an image processing unit, a timing controller configured to receive various signals through a mobile industry processor interface (MIPI) connected to the image processing unit, and a display module configured to display an image under the control of the timing controller, wherein the timing controller includes a logic block configured to control the display module, and a self-recovery block configured to output a self-command signal for escaping an abnormal state when the logic block is faced with the abnormal state due to an external environment factor.

In another aspect, there is a method for driving a display device including when a timing controller is faced with an abnormal state due to an external environment factor, deciding whether or not an image processing unit retransmits a command signal capable of escaping the abnormal state to the timing controller, when the image processing unit does not retransmit the command signal capable of escaping the abnormal state to the timing controller, outputting a self-command signal from the timing controller, and driving the timing controller in a normal operation state.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 1 to 10.

Figure 1:
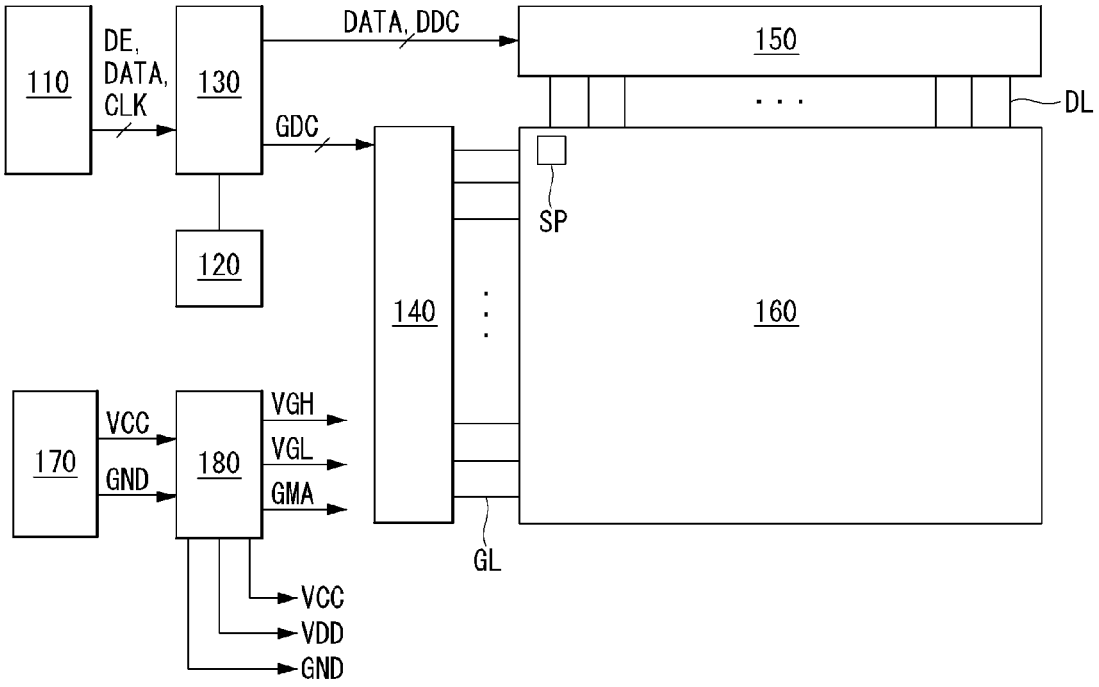
FIG. 1 is a schematic block diagram of a display device according to an exemplary embodiment of the invention.
Figure 2:
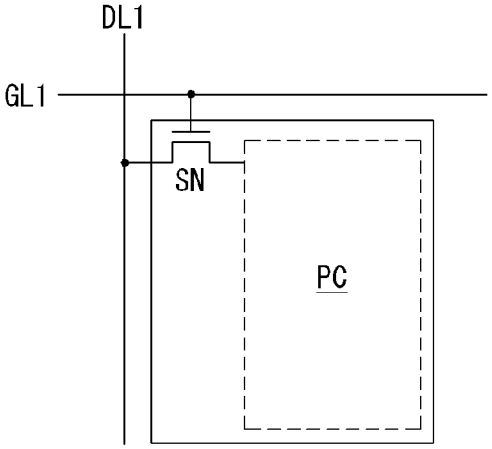
FIG. 2 schematically illustrates a configuration of a subpixel shown in FIG. 1.
Figure 3:
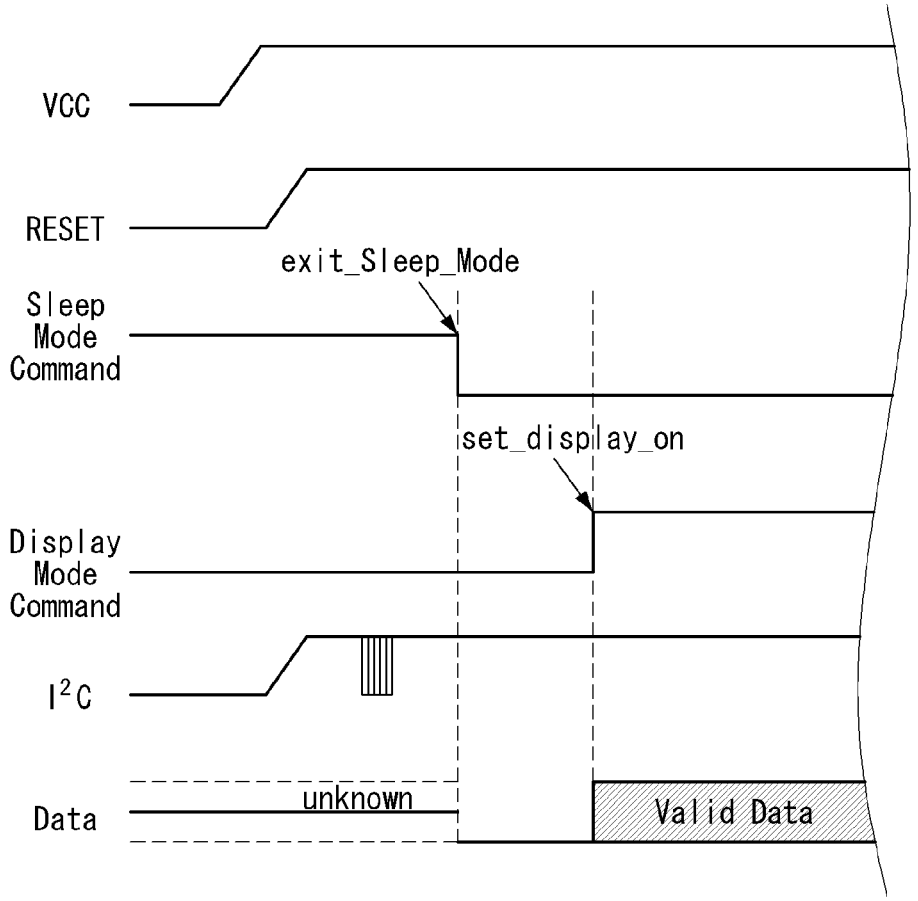
FIG. 3 is a timing diagram of a data signal and a command signal between an image processing unit and a timing controller shown in FIG. 1.
Figure 4:
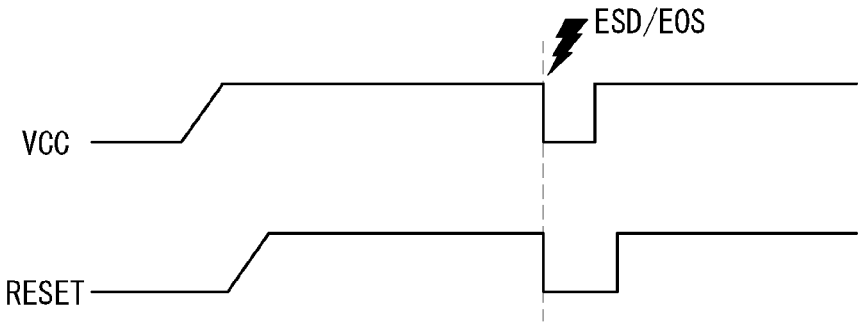
FIG. 4 is a waveform diagram showing a state where a reset signal is hung on a timing controller due to an external environment factor.

FIG. 1 is a schematic block diagram of a display device according to an exemplary embodiment of the invention. FIG. 2 schematically illustrates a configuration of a subpixel shown in FIG. 1. FIG. 3 is a timing diagram of a data signal and a command signal between an image processing unit and a timing controller shown in FIG. 1. FIG. 4 is a waveform diagram showing a state where a reset signal is hung on a timing controller due to an external environment factor.

As shown in FIG. 1, a display device according to an exemplary embodiment of the invention includes system boards 110 and 170, driving boards 120, 130, and 180, and display modules 140, 150, and 160.

The system boards 110 and 170 include an image processing unit 110 and a power supply unit 170. The driving boards 120, 130 and 180 include an external memory 120, a timing controller 130, and a power conversion unit 180. The display modules 140, 150 and 160 include a gate driver 140, a data driver 150, and a panel 160.

The image processing unit 110 supplies a data signal DATA, a data enable signal DE, clocks CLK, etc. to the timing controller 130. The power supply unit 170 supplies a first potential voltage VCC and a ground level voltage GND to the power conversion unit 180.

The external memory 120 supplies data stored therein to the timing controller 130. The external memory 120 stores extended display identification data (EDID) including a resolution, a frequency, timing information, etc. of the panel 160 or compensation data.

The timing controller 130 outputs a gate timing control signal GDC for controlling operation timing of the gate driver 140 and a data timing control signal DDC for controlling operation timing of the data driver 150. The timing controller 130 supplies the data signal DATA received from the image processing unit 110 along with the data timing control signal DDC to the data driver 150.

The power conversion unit 180 converts the first potential voltage VCC and the ground level voltage GND received from the power supply unit 170 into a gate high voltage VGH, a gate low voltage VGL, a gamma voltage GMA, and a second potential voltage VDD and outputs them. The gate high voltage VGH, the gate low voltage VGL, the gamma voltage GMA, the first potential voltage VCC, and the second potential voltage VDD output from the power conversion unit 180 are used in the external memory 120, the timing controller 130, the gate driver 140, the data driver 150, and the panel 160.

The gate driver 140 shifts levels of the gate voltages VGH and VGL in response to the gate timing control signal GDC received from the timing controller 130 and outputs a gate signal. The gate driver 140 supplies the gate signal to subpixels SP included in the panel 160 through gate lines GL.

The data driver 150 samples and latches the digital data signal DATA in response to the data timing control signal DDC received from the timing controller 130 and converts the latched digital data signal DATA into an analog data signal DATA using a gamma reference voltage. The data driver 150 then outputs the analog data signal DATA. The data driver 150 supplies the analog data signal DATA to the subpixels SP included in the panel 160 through data lines DL.

The panel 160 displays an image corresponding to the gate signal and the analog data signal DATA. The panel 160 includes the subpixels SP, which control light to display the image. As shown in FIG. 2, each of the subpixels SP includes a switching transistor SW connected to a gate line GL1 and a data line DL1, and a pixel circuit PC which is driven in response to the data signal DATA supplied through the switching transistor SW. The subpixels SP may configure a liquid crystal display panel including liquid crystal elements or an organic light emitting display panel including organic light emitting elements depending on configuration of the pixel circuits PC.

When the panel 160 is configured as the liquid crystal display panel, the panel 160 may be implemented in a twisted nematic (TN) mode, a vertical alignment (VA) mode, an in-plane switching (IPS) mode, a fringe field switching (FFS) mode, or an electrically controlled birefringence (ECB) mode. When the panel 160 is configured as the organic light emitting display panel, the panel 160 may be implemented in a top emission type, a bottom emission type, or a dual emission type.

The above-described display device may be implemented as a mobile industry processor interface (MIPI) type display device, in which the image processing unit 110 and the timing controller 130 use the MIPI. In the MIPI type display device, the image processing unit 110 supplies various signals including a command signal, the data signal, and the clock to the timing controller 130 through the MIPI of its transmitting terminal MIPI Tx. The command signal is closely related with a drive of the display device and includes a sleep mode and a display mode.

Signals used in the MIPI are defined as standard signals in a corresponding field and also are variously defined. Thus, the embodiment of the invention describes only the command signal used therein below. The sleep mode of the command signal includes a sleep exit mode exit_sleep_mode indicating the exit of a sleep state and a sleep entrance mode enter_sleep_mode indicating the entrance of the sleep state. The display mode of the command signal includes a display on-mode set_display_on defining a transmission period of the data signal and a display off-mode set_display_off defining a non-transmission period of the data signal.

The MIPI type display device according to the embodiment of the invention is described in detail below with reference to FIG. 3.

When a user turns on the power of the MIPI type display device, the first potential voltage VCC output from the power supply unit 170 is supplied to the driving boards 120, 130, and 180. A signal hung on a reset terminal of the timing controller 130 is converted from a low logic level to a high logic level. The timing controller 130 collects the various extended display identification data (EDID) or the compensation data through $I^2C$ interface connected to the external memory 120 and is ready to drive the panel 160.

The image processing unit 110 supplies the common signal of the sleep exit mode exit_sleep_mode to the timing controller 130. The image processing unit 110 then supplies the common signal of the display on-mode set_display_on to the timing controller 130.

The timing controller 130 gets ready to be in a normal driving state by receiving the common signal of the sleep exit mode exit_sleep_mode and the common signal of the display on-mode set_display_on. Thus, the timing controller 130 receives a valid data signal 'Valid Data' from the image processing unit 110 in the normal driving state, and the panel 160 displays an image corresponding to the valid data signal 'Valid Data'.

As shown in FIG. 4, the first potential voltage VCC may be abnormally turned off or on due to an external environment factor, for example, a surge of a very high voltage such as electrostatic discharge (ESD) or and electrical overstress (EOS). In this instance, a reset signal RESET is hung on the timing controller 130. In general, the reset signal RESET is held at a high logic level and is converted from a low logic level to a high logic level.

In this instance, when the command signal of the sleep mode is not received again from the image processing unit, the related art MIPI type display device appeared an abnormal display state or stopped working. Namely, because the image processing unit did not monitor a state of a power source supplied to a display module, the related art MIPI type display device appeared the abnormal display state or stopped working. Only when the power source was normally turned on, the image processing unit temporarily transmitted the command signal including the sleep mode and the display mode to the timing controller. Thus, even when the timing controller and the display module were faced with an abnormal state of the power source, the image processing unit did not retransmit the command signal to the timing controller. Further, bidirectional communication between the system board and the timing controller was not performed in a video mode.

To solve the above-described problem, the timing controller of the MIPI type display device according to the embodiment of the invention is configured as follows.

Figure 5:
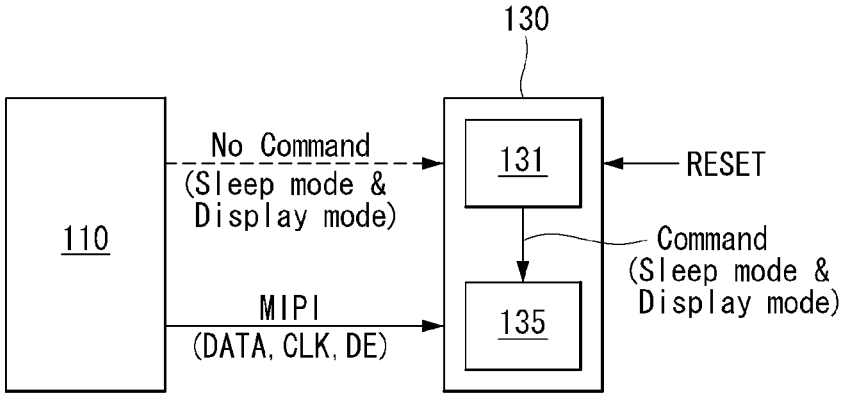
FIG. 5 is a detailed block diagram of a timing controller according to an exemplary embodiment of the invention.

FIG. 5 is a detailed block diagram of the timing controller according to the embodiment of the invention.

As shown in FIGS. 1 to 5, the timing controller 130 includes a logic block 135 and a self-recovery block 131. When the logic block 135 is faced with an abnormal state, the self-recovery block 131 produces a self-command signal for escaping the abnormal state of the logic block 135 by itself and supplies the self-command signal to the logic block 135. The logic block 135 controls the gate driver 140 and the data driver 150.

When the external environment factor such as the electrostatic discharge and the electrical overstress entirely affects the display device including the image processing unit 110 and the timing controller 130, the image processing unit 110 may supply the command signal including the sleep mode and the display mode to the timing controller 130. However, when the external environment factor such as the electrostatic discharge and the electrical overstress locally affects the timing controller 130 or the display modules 140, 150, and 160, the image processing unit 110 does not supply any command signal to the timing controller 130.

The self-recovery block 131 recognizes that the reset signal RESET is hung on the timing controller 130, and produces the self-command signal including the sleep mode and the display mode by itself. The self-command signal produced for escaping the abnormal state of the logic block 135 is supplied to the logic block 135.

The self-recovery block 131 cannot decide whether the external environment factor entirely or locally affects the display device. Thus, the self-recovery block 131 cannot produce the self-command signal when the command signal for escaping the abnormal state of the display device is not received from the image processing unit 110. For this, the self-recovery block 131 may detect and decide characteristics of a signal supplied through the MIPI at a receiving terminal MIPI Rx of the timing controller 130.

When an abnormal state of the power of the display device resulting from the external environment factor is defined by the generation of "Abnormal Power Off/On & RESET", a method for driving the MIPI type display device according to the embodiment of the invention is described below.

(1) Method for driving the MIPI type display device when the command signal is not input from the image processing unit Abnormal Power Off/On & RESET→check whether or not the command signal is input (by the timing controller)→enter_sleep_mode/set_display_off command (by the timing controller)→exit_sleep_mode command (by the timing controller)→set_display_on command (by the timing controller)→output of display data (by the image processing unit)

(2) Method for driving the MIPI type display device when the command signal is input from the image processing unit Abnormal Power Off/On & RESET→check whether or not the command signal is input (by the timing controller)→enter_sleep_mode/set_display_off command (by the image processing unit)→exit_sleep_mode command (by the image processing unit)→set_display_on command (by the image processing unit)→output of display data (by the image processing unit)

The method for driving the MIPI type display device according to the embodiment of the invention is additionally described below with reference to operations of the image processing unit 110 and the timing controller 130 for the sake of brevity and ease of reading.

Figure 6:
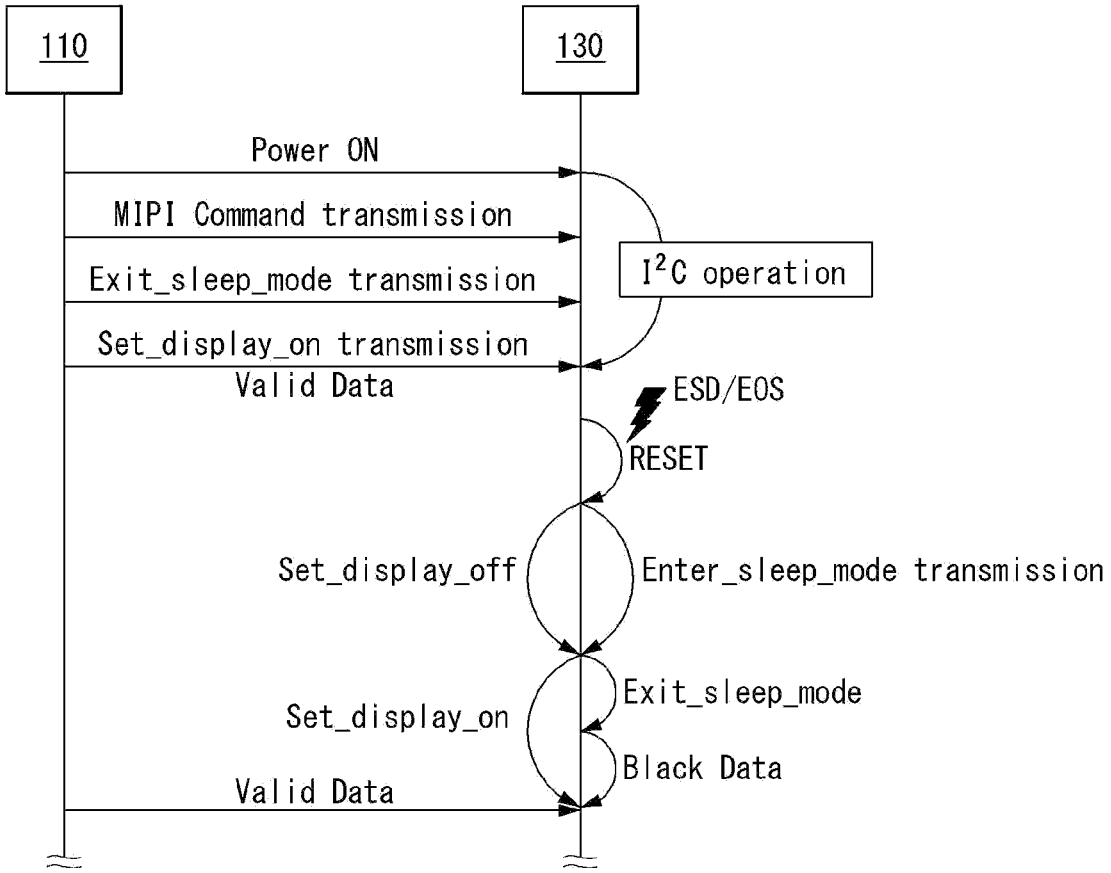
FIG. 6 is a flow chart showing operations of an image processing unit and a timing controller according to an exemplary embodiment of the invention when a display device is affected by an external environment factor.
Figure 7:
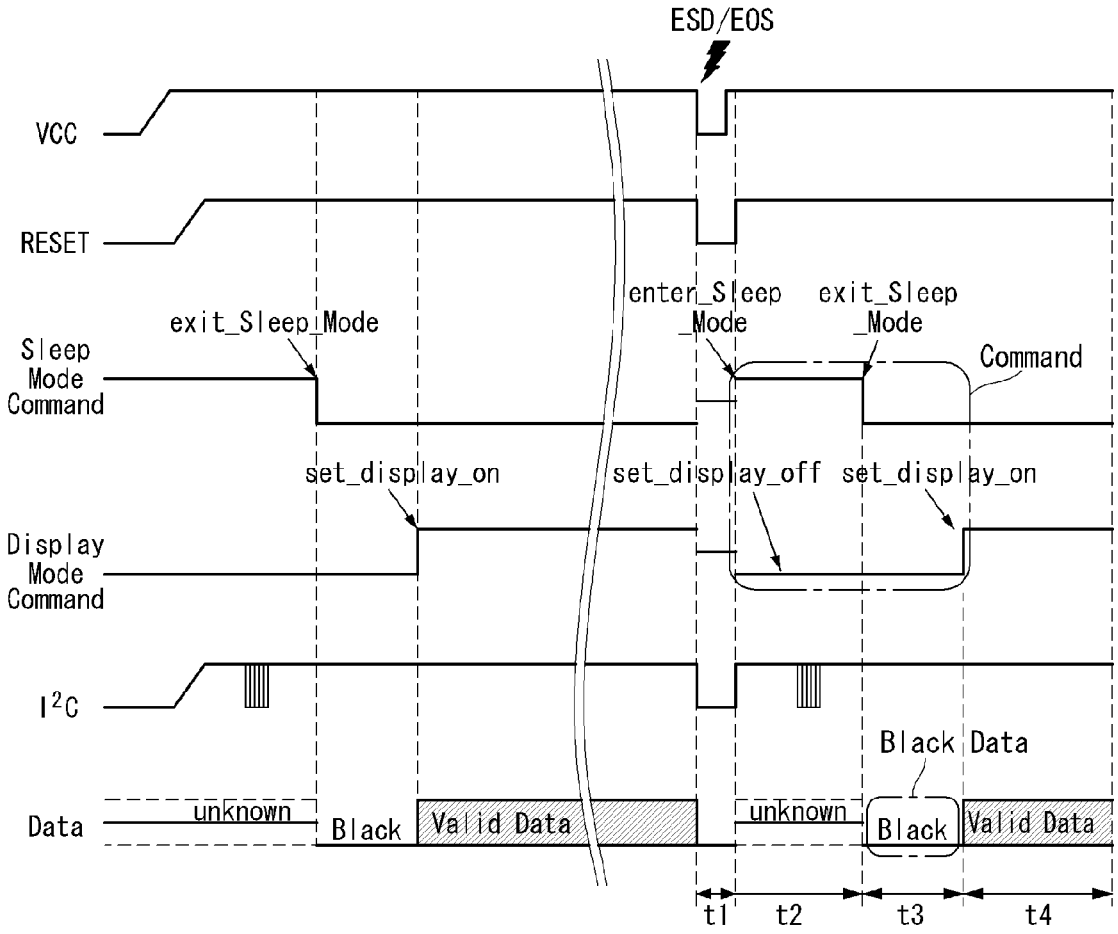
FIG. 7 is a waveform diagram showing operations of an image processing unit and a timing controller shown in FIG. 6.
Figure 8:
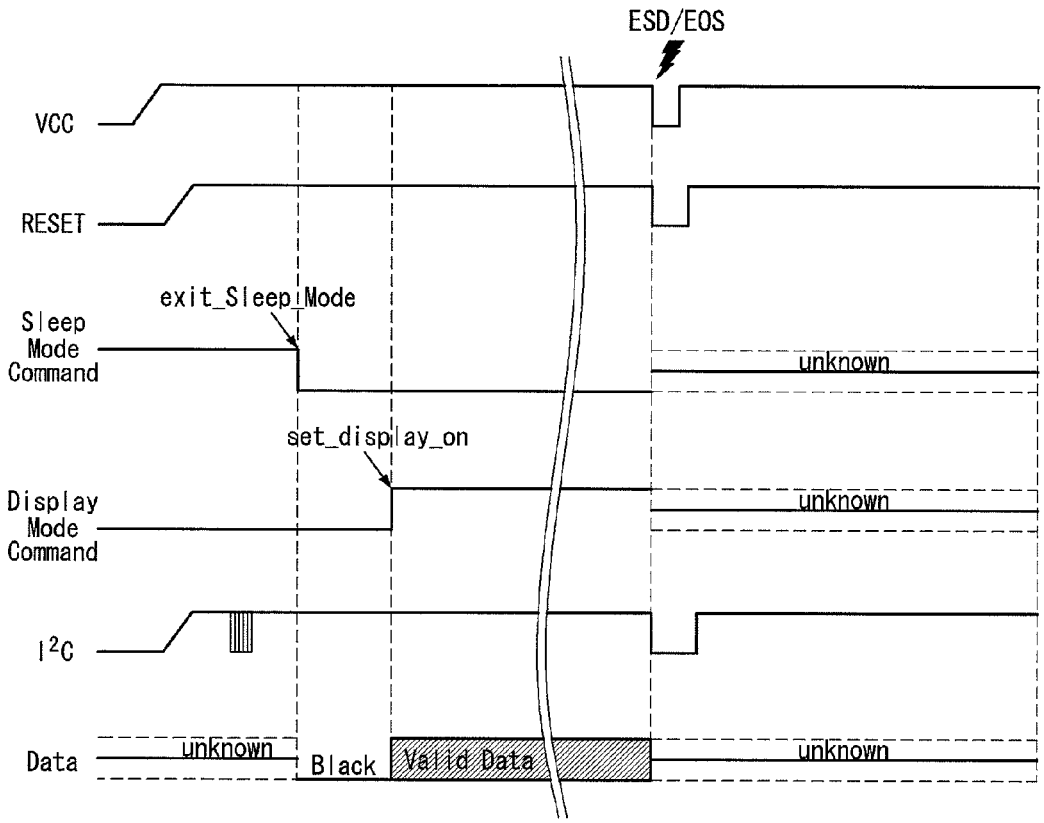
FIG. 8 is a waveform diagram showing operations of a related art image processing unit and a related art timing controller when a display device is affected by an external environment factor.

FIG. 6 is a flow chart showing operations of the image processing unit and the timing controller according to the embodiment of the invention when the display device is affected by the external environment factor. FIG. 7 is a waveform diagram showing operations of the image processing unit and the timing controller shown in FIG. 6. FIG. 8 is a waveform diagram showing operations of the related art image processing unit and the related art timing controller when the display device is affected by the external environment factor.

As shown in FIGS. 1 to 7, when the user turns on the power of the MIPI type display device, the power supply unit 170 outputs the first potential voltage VCC. The reset signal RESET of the timing controller 130 is converted from the low logic level to the high logic level. Afterward, the timing controller 130 collects the extended display identification data (EDID) including a resolution, a frequency, timing information, etc. of the panel 160 or the compensation data from the external memory 120 through the $I^2C$ interface. Namely, the timing controller 130 performs an initial operation.

Next, the image processing unit 110 supplies the common signal including the sleep entrance mode enter_sleep_mode and the display off-mode set_display_off to the timing controller 130 through the MIPI.

Afterward, the image processing unit 110 transmits the common signal of the sleep exit mode exit_sleep_mode to the timing controller 130. In the embodiment of the invention, when a falling edge of the command signal of the high logic level in the sleep entrance mode enter_sleep_mode is converted into the command signal of the low logic level in the sleep exit mode exit_sleep_mode, the timing controller 130 exits the sleep state.

Next, the image processing unit 110 transmits the common signal of the display on-mode set_display_on to the timing controller 130. In the embodiment of the invention, when a rising edge of the command signal of the low logic level in the display off-mode set_display_off is converted into the command signal of the high logic level in the display on-mode set_display_on, the image processing unit 110 may transmit the valid data signal to the timing controller 130.

The setting of the timing controller 130 is completed by the command signal including the sleep exit mode exit_sleep_mode and the display on-mode set_display_on. Thus, the image processing unit 110 simultaneously supplies the command signal of the display on-mode set_display_on and the valid data to the timing controller 130. In this instance, after the timing controller 130 internally receives the command signal of the display on-mode set_display_on, the timing controller 130 outputs the data signal synchronized with a vertical sync signal Vsync, so as to prevent the abnormal display state. Because the valid data signal is normally supplied in a state where the common signal including the sleep exit mode exit_sleep_mode and the display on-mode set_display_on is supplied, a normal display operation is performed.

Next, when the external environment factor 'ESD/EOS' such as the electrostatic discharge and the electrical overstress affects the display device during a period 't1', the first potential voltage VCC output from the power supply unit 170 bounces from the ground level voltage GND to the first potential voltage VCC. The reset signal RESET is hung on the timing controller 130.

In this instance, the common signal including the sleep exit mode exit_sleep_mode and the display on-mode set_display_on provided by the image processing unit 110 becomes an unknown state. The valid data signal 'Valid Data' provided by the image processing unit 110 also becomes an unknown state.

Next, during a period 't2', the self-recovery block 131 outputs the common signal including the sleep entrance mode enter_sleep_mode and the display off-mode set_display_off and supplies the common signal to the logic block 135. Hence, the timing controller 130 restarts to collect the extended display identification data (EDID) or the compensation data through the $I^2C$ interface. When the timing controller 130 enters into the sleep entrance mode enter_sleep_mode, the image processing unit 110 does not transmit any data signal.

Next, during a period 't3', the self-recovery block 131 outputs the common signal including the sleep exit mode exit_sleep_mode and the display on-mode set_display_on and supplies the common signal to the logic block 135. In this instance, the self-recovery block 131 outputs the common signal of the sleep exit mode exit_sleep_mode and outputs the common signal of the display on-mode set_display_on after N frames passed, where N is an integer equal to or greater than 1.

The self-recovery block 131 may output black data displaying black between the common signal of the sleep exit mode exit_sleep_mode and the common signal of the display on-mode set_display_on. In this instance, the self-recovery block 131 may collect and output the black data from the external memory 120.

A reason to output the black data during the period 't3' is to prevent the data signal of the unknown state from being displayed on the panel 160 during the period 't3'. Further, the reason is to discharge parasitic capacitances remaining in the panel 160 using the black data.

The setting of the timing controller 130 is normally started due to the common signal including the sleep exit mode exit_sleep_mode and the display on-mode set_display_on. Thus, the image processing unit 110 simultaneously supplies the command signal of the display on-mode set_display_on and the valid data signal 'Valid Data' to the timing controller 130 during a period 't4'. Hence, because the valid data signal 'Valid Data' from the image processing unit 110 is normally supplied to the timing controller 130, a normal display operation is performed.

On the other hand, the related art MIPI type display device is in the abnormal state due to the external environment factor and operates as follows.

As shown in FIG. 8, when the external environment factor 'ESD/EOS' such as the electrostatic discharge and the electrical overstress affects the display device, the first potential voltage VCC output from the power supply unit bounces from the ground level voltage GND to the first potential voltage VCC. The reset signal RESET is hung on the timing controller.

In this instance, the common signal including the sleep exit mode exit_sleep_mode and the display on-mode set_display_on provided by the image processing unit becomes an unknown state. The valid data signal 'Valid Data' provided by the image processing unit also becomes a data signal of an unknown state.

Afterward, because the image processing unit does not supply any command signal for the normal state of the display device to the timing controller, the timing controller is continuously held in the unknown state and finally stops working.

As described above, even if the MIPI type display device according to the embodiment of the invention is faced with the abnormal state due to the external environment factor 'ESD/EOS' such as the electrostatic discharge and the electrical overstress, the MIPI type display device according to the embodiment of the invention may escape the abnormal state and may be normally driven. On the other hand, when the related art MIPI type display device is faced with the abnormal state due to the external environment factor 'ESD/EOS', the related art MIPI type display device cannot escape the abnormal state or stopped working.

A method for driving the MIPI type display device according to the embodiment of the invention is described below.

Figure 9:
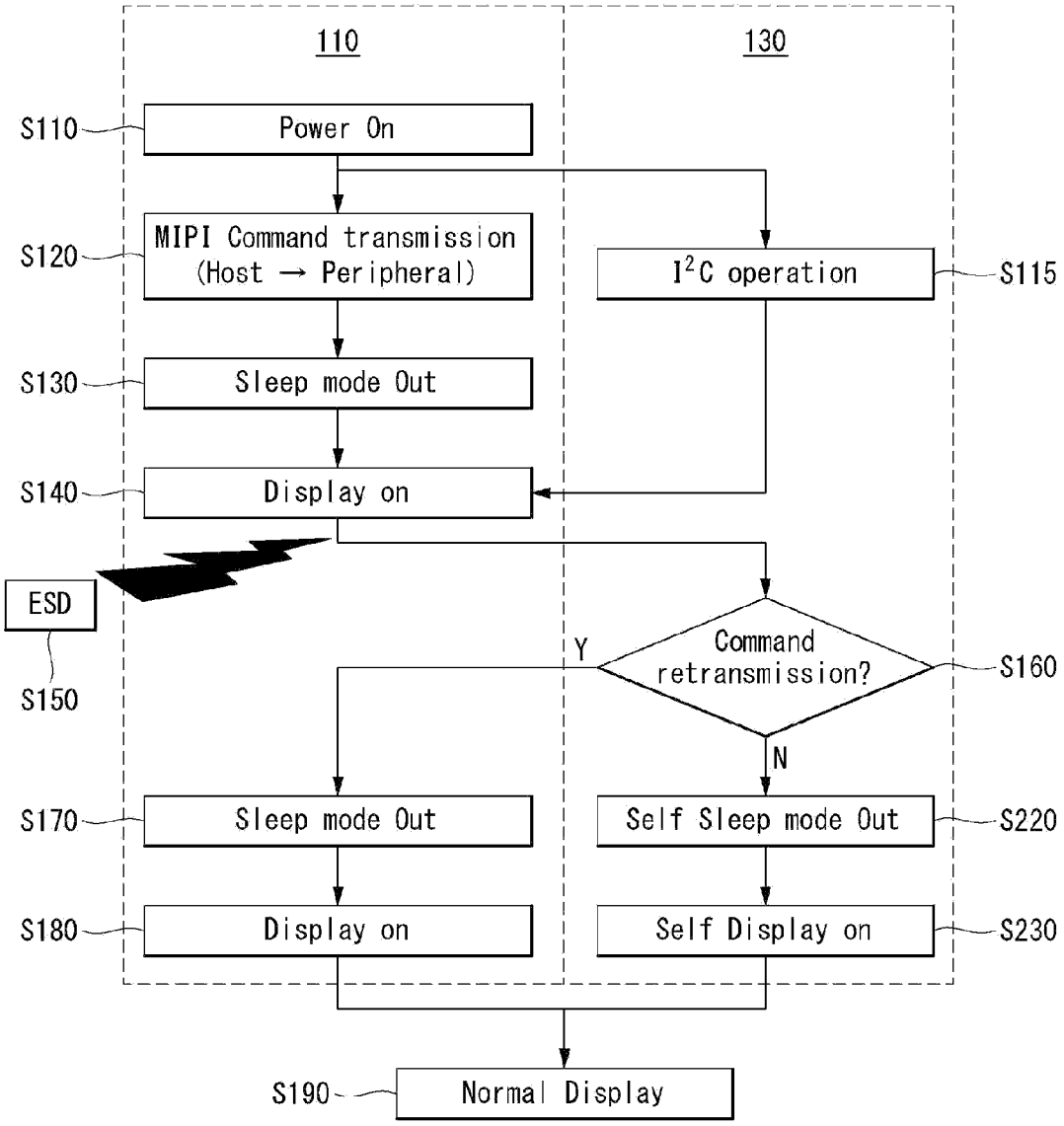
FIG. 9 is a flow chart illustrating a method for driving a display device according to an exemplary embodiment of the invention.
Figure 10:
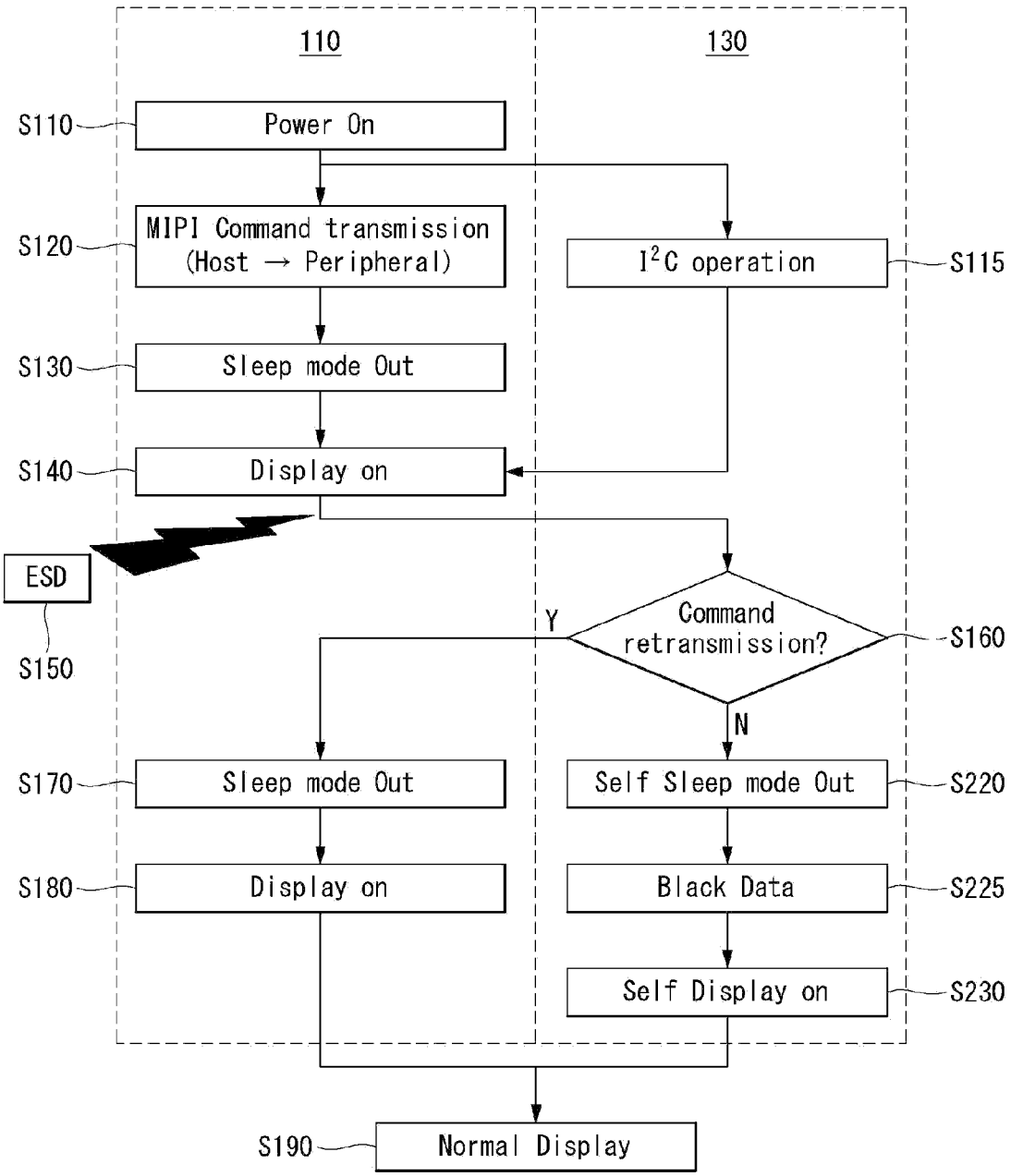
FIG. 10 is a flow chart illustrating a method for driving a display device according to another exemplary embodiment of the invention.

FIG. 9 is a flow chart illustrating a method for driving the display device according to the embodiment of the invention. FIG. 10 is a flow chart illustrating a method for driving a display device according to another exemplary embodiment of the invention.

As shown in FIG. 9, the user turns on the power of the display device in step S110. Hence, the timing controller 130 collects extended display identification data (EDID) or compensation data through $I^2C$ interface in step S115.

Next, the image processing unit 110 (corresponding to a host) transmits MIPI command signal to the timing controller 130 (corresponding to a peripheral) in step S120.

Next, the image processing unit 110 transmits a command signal indicating the exit of a sleep state to the timing controller 130 in step S130.

Next, the image processing unit 110 transmits a command signal defining a transmission period of the data signal to the timing controller 130 in step S140.

Afterward, the display device is faced with an abnormal state due to an external environment factor 'ESD', for example, electrostatic discharge in step S150. In this instance, it is decided whether or not the image processing unit 110 retransmits the command signal capable of escaping the abnormal state to the timing controller 130 in step S160.

When the image processing unit 110 retransmits the command signal capable of escaping the abnormal state to the timing controller 130, the display device operates as follows.

The image processing unit 110 transmits the command signal indicating the exit of the sleep state to the timing controller 130 in step S170. The image processing unit 110 also transmits the command signal defining the transmission period of the data signal to the timing controller 130 in step S180. Afterward, the timing controller 130 escapes the abnormal state and performs a normal display operation in step S190.

On the contrary, when the image processing unit 110 does not retransmit the command signal capable of escaping the abnormal state to the timing controller 130, the display device operates as follows.

The timing controller 130 produces the self-command signal indicating the exit of the sleep state from itself and transmits the self-command signal to itself in step S220. The timing controller 130 also produces the self-command signal defining the transmission period of the data signal from itself and transmits the self-command signal to itself in step S230. Afterward, the timing controller 130 escapes the abnormal state by itself and performs the normal display operation in step S190.

Alternatively, as shown in FIG. 10, when the image processing unit 110 does not retransmit the command signal capable of escaping the abnormal state to the timing controller 130, the timing controller 130 outputs black data between the self-command signal indicating the exit of the sleep state and the self-command signal defining the transmission period of the data signal in step S225.

A reason to output the black data during the above period is to prevent the data signal of the unknown state from being displayed on the panel 160 during the above period. Further, the reason is to discharge parasitic capacitances remaining in the panel 160 using the black data.

As described above, the display device according to the embodiment of the invention escapes the abnormal state using the self-command signal produced by the timing controller when the power of the display device is abnormally turned on or off due to the external environment factor and then the image processing unit does not transmit the command signal to the timing controller, thereby performing the stable operation. Further, because the timing controller escapes the abnormal state using the self-command signal, the display device according to the embodiment of the invention may implement the stable image.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

an image processing unit;

a timing controller configured to receive various signals through a mobile industry processor interface (MIPI) connected to the image processing unit; and a display module configured to display an image under control of the timing controller, wherein the timing controller includes:

a receiving terminal MIPI Rx configured to receive a reset signal which follows a first potential voltage (VCC) output from a power supply unit;

a logic block configured to control the display module; and a self-recovery block configured to output self-command signals for escaping an abnormal state when the logic block is faced with the abnormal state due to an external environment factor, wherein the self-recovery block is configured to:

monitor the reset signal received at the receiving terminal of the timing controller, determine whether a change in a logic level of the reset signal has occurred, sequentially output a first command signal of a sleep mode indicating a sleep entrance mode to the timing controller, followed by the first command signal of the sleep mode indicating a sleep exit mode to the timing controller, and followed by a second command signal of a display mode indicating a display on-mode to the timing controller, in response to determining that the change in the logic level of the reset signal has occurred, wherein self-recovery block of the timing controller outputs black data displaying black in a period between output of the first command signal of the sleep exit mode and output of the second command signal of the display on-mode, and wherein the external environment factor includes electrostatic discharge (ESD) or electrical overstress (EOS).

2. The display device of claim 1, wherein when a reset signal is hung on the logic block due to the external environment factor, the self-recovery block outputs the first command signal indicating the sleep entrance mode and the second command signal indicating a display off-mode and then outputs the first command signal indicating the sleep exit mode and the second command signal indicating the display on-mode.

3. The display device of claim 2, wherein when the reset signal is hung on the logic block due to the external environment factor, the self-recovery block determines whether or not a command signal for escaping the abnormal state is received from the image processing unit, and then outputs the self-command signals.

4. The display device of claim 3, wherein the self-recovery block outputs the first command signal of the sleep exit mode and the second command signal of the display on-mode, after N frames passed, where N is an integer equal to or greater than 1.

5. A method for driving a display device, the method comprising:

determining, by a timing controller, whether an image processing unit retransmits a command signal capable of escaping an abnormal state due to an external environment factor to the timing controller when the timing controller is in the abnormal state;

outputting, by the timing controller, self-command signals to itself, in response to determining that the image processing unit does not retransmit the command signal capable of escaping an abnormal state due to an external environment factor to the timing controller when the timing controller is in the abnormal state; and driving the timing controller in a normal operation state, wherein the outputting of the self-command signals includes:

monitoring, by the timing controller, a reset signal received at a receiving terminal of the timing controller, the reset signal following a first potential voltage (VCC) output from a power supply unit, determining, by the timing controller, whether a change in a logic level of the reset signal has occurred, sequentially outputting, by the timing controller, a first command signal of a sleep mode indicating a sleep entrance mode to the timing controller, followed by the first command signal of the sleep mode indicating a sleep exit mode to the timing controller, and followed by a second command signal of a display mode indicating a display on-mode to the timing controller, in response to determining that the change in the logic level of the reset signal has occurred, and wherein the timing controller outputs black data displaying black in a period between outputting of the first command signal of the sleep exit mode and outputting of the second command signal of the display on-mode.

6. The method of claim 5, wherein the outputting of the self-command signals includes outputting the first command signal of the sleep mode indicating the sleep exit mode and outputting the second command signal of the display mode indicating the display on-mode after N frames passed, where N is an integer equal to or greater than 1.

7. The method of claim 5, wherein the external environment factor includes electrostatic discharge (ESD) or electrical overstress (EOS).

8. The method of claim 5, wherein the outputting of the self-command signals is performed when a reset signal is hung on the timing controller due to the external environment factor.

* * * * *